US005533685A

United States Patent [19]

Heck

[11] Patent Number: 5,533,685

[45] Date of Patent: Jul. 9, 1996

[54] CENTRIFUGAL IMPACT CRUSHER

[75] Inventor: Jean-Marie Heck, Grivegnee, Belgium

[73] Assignee: Magotteaux International, Chevremont, Belgium

[21] Appl. No.: 355,523

[22] Filed: Dec. 14, 1994

[30] Foreign Application Priority Data

Dec. 14, 1993 [BE] Belgium ..... 09301387

[51] Int. Cl.[6] ..... B02C 19/00

[52] U.S. Cl. ..... 241/275; 241/285.5; 241/300

[58] Field of Search ..... 241/5, 275, 285.1, 241/285.2, 300

[56] References Cited

U.S. PATENT DOCUMENTS

| | | | |
|---|---|---|---|
| 3,168,991 | 2/1965 | Herman | 241/275 |
| 3,578,254 | 5/1971 | Wood | 241/275 |
| 4,090,673 | 5/1978 | Ackers et al. | 241/275 |
| 4,659,026 | 4/1987 | Krause et al. | 241/275 |
| 4,699,326 | 10/1987 | Warren | 241/275 |
| 5,248,101 | 9/1993 | Rose et al. | 241/275 X |
| 5,323,974 | 6/1994 | Watajima | 241/275 |

*Primary Examiner*—Timothy V. Eley
*Attorney, Agent, or Firm*—Schmeiser, Olsen & Watts

[57] ABSTRACT

The centrifugal impact crusher includes, among others, a cylindrical housing (10), a turntable (22) supported by a vertical bearing (24), a series of ejectors (27) fixed to the turntable (22), a series of anvils (34) fixed to an anvil ring (30) around the turntable (22) and lining (14) on the internal wall of the housing (10). In order to damp out the significant impacts on the anvils (34), the anvil ring (30) is supported by a series of flat polygonal blocks (38) standing up on edge and resting freely via one of the flat sides on the upper horizontal edge of the lining (14) of the tank (10).

6 Claims, 3 Drawing Sheets

CENTRIFUGAL IMPACT CRUSHER

FIELD OF THE INVENTION

The present invention relates to a centrifugal impact crusher comprising a cylindrical housing with a removable closure cover, a central device for feeding material to be crushed through the cover, a turntable supported by a vertical bearing and associated with means for turning the table around the central axis of the crusher, a series of ejectors fixed to the turntable, a series of anvils fixed to an anvil ring around the turntable and lining fixed on the internal all of the housing.

BACKGROUND OF THE INVENTION

Crushers of this sort are known, for example, from U.S. Pat. No. 5,248,101 issued to Rose et al. These crushers are employed for crushing all sorts of materials, especially rocks and recently also in cement making. The material to be crushed is poured through the feed device onto the turntable and is thrown, under the action of the ejectors and under the effect of centrifugal force, violently towards anvils on which it shatters to fall, in crushed form, to the bottom of the crusher from where it is discharged.

It is obvious that the ejectors and, above all, the anvils undergo very violent stressing and are subject to rapid wear. The anvils in particular must absorb the significant impacts caused by the material thrown by the ejectors. It even happens that anvils break up under the impact of abnormally massive pieces or when, which may also happen, an ejector is detached and thrown against the anvils.

For the anvils to resist as well as possible, they need to be fixed at such a height that they receive most of the projectiles at their centre. This appropriate fastening in terms of height causes no problems if the crusher is always used to crush the same materials with constant particle size. In contrast, if the particle size of the material to be crushed changes, the trajectory of the material thrown by the ejectors varies so that the anvils, which are mounted at a fixed height, receive the projectiles on the upper or lower edges and therefore wear much more quickly. It may even happen that the material does not reach its target and becomes crushed below the anvils, on the lining of the housing.

In order to overcome this risk and be able to use a crusher for various particle sizes, systems have already been proposed for vertical adjustment of the height at which the anvil ring is fixed.

One of these systems consists in mounting the anvil ring on sorts of helicoid ramps fixed to the internal wall of the housing and having several ledges at various levels for supporting the anvil ring. In order to change the height at which the anvils are positioned, it is therefore sufficient to lift up the ring, turn it through a given angle and place it on a higher or lower ledge. This system suffers from the handicap that the wall of the housing must be pierced for fixing the ramps for supporting the ring or that there is a need to provide welds for fixing the ramps to the wall.

SUMMARY OF THE INVENTION

The object of the present invention is to provide a crusher of the sort described in the preamble with an improved system for suspending the anvil ring which makes it possible susbtantially to reduce the problems described hereinabove.

In order to achieve this objective, the invention proposes a crusher as defined hereinabove, which is characterized in that the anvil ring is supported by a series of flat polygonal blocks standing up on edge and resting freely via one of their flat sides on the upper horizontal edge of the lining of the housing.

In other words, the anvil ring is not fixed to the wall but simply rests freely on the lining via a series of blocks. This has the dual advantage that it is not necessary to pierce the wall of the housing for suspending the anvil ring and, above all, of creating suspension with a "weak link" effect. In fact, given that the ring rests freely on the lining, it can slide on the latter under the effect of a violent impact on one or more anvils, which allows the latter better to absorb the impacts and to be less exposed to the risk of disastrous breaking.

According to an advantageous embodiment, each block has an off-centred opening while the anvil ring at its outside periphery includes a series of journals engaged respectively in each of the openings in the blocks in order to support the ring.

By virtue of the off-centred nature of this support opening it is thus possible to change the height at which the anvil ring is suspended simply by changing the position of each of these blocks. The height of the anvils may thus easily be adapted to the particle size and nature of the material to be crushed.

The journals and the openings in the blocks preferably have complementary polygonal cross-sections, of the same type as those of the blocks.

In the simplest embodiment, the cross-sections of the blocks, those of their openings and those of the journals are square.

The opening in each block is preferably located such that the distances between its centre and each of the sides of the polygonal block are different from each other. In this way there are as many positions for height adjustment of the ring as there are sides to the blocks. If the latter have square cross-section there will consequently be four possibilities for adjusting the height of the anvil ring.

BRIEF DESCRIPTION OF THE DRAWINGS

Other features and characteristics of the invention will emerge form the detailed description of an advantageous embodiment set out below by way of illustration with reference to the appended figures in which.

DETAILED DESCRIPTION OF THE DRAWINGS

Figure 1:
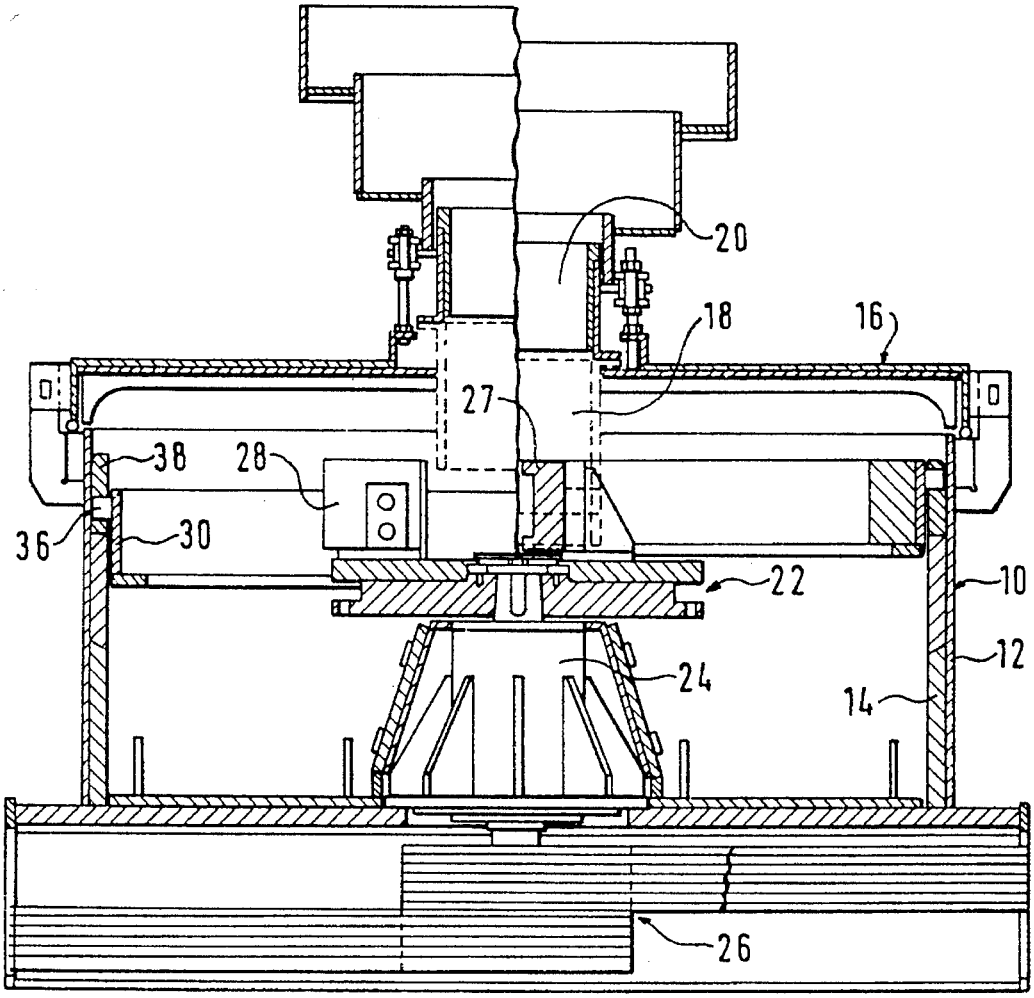
FIG. 1 shows schematically, in vertical section, the essential components of a crusher according to the present invention.

The crusher represented schematically in FIG. 1 includes a cylindrical housing 10 of which the wall 12 is lined, on the inside, with metal lining plates 14. The housing is closed at the top by a removable cover 16 with a central opening 18 associated with a feed device 20 for introducing the material to be crushed into the crusher. At the centre of the crusher there is a turntable 22 of which the vertical rotation spindle passes through a support bearing 24 below which there is an appropriate drive means 26, for example a system of pulleys with transmission belts in order to turn the table 22 about the vertical axis of the crusher.

On the turntable 22 are arranged, in a way known per se, a series of ejectors 27 which may be fixed directly to the table 22 or to ejector supports represented schematically as 28 and secured to the table 22.

These ejectors are located inside a ring of anvils which are generally supported by an anvil ring 30. These anvils may be mounted in the way represented in FIG. 2 which shows a plan view of the anvil ring 30 with a series of individual supports 32 for each anvil 34, these supports 32 being welded directly onto the internal face of the ring 30.

By way of alternative, the anvils may equally well be held freely in place in the ring 30 where they are wedged by an arc effect. Reference is made to U.S. Pat. No. 5,184,784, issued to Rose et al, which discloses a mounting system for the anvils which relies on the arc effect to cause the anvils to be self-restraining the radial direction.

During the crushing operation, the turntable is given a rotational speed of the order of 1,000 rpm depending on the nature of the material to be crushed. The material to be crushed, which is poured out by the feed device onto the turntable is thrown by the ejectors under the effect of centrifugal force towards the outside and shatters on the anvils to fall down, in crushed form, to the bottom of the crusher from where it is discharged continuously by means which have not been represented.

Figure 2:
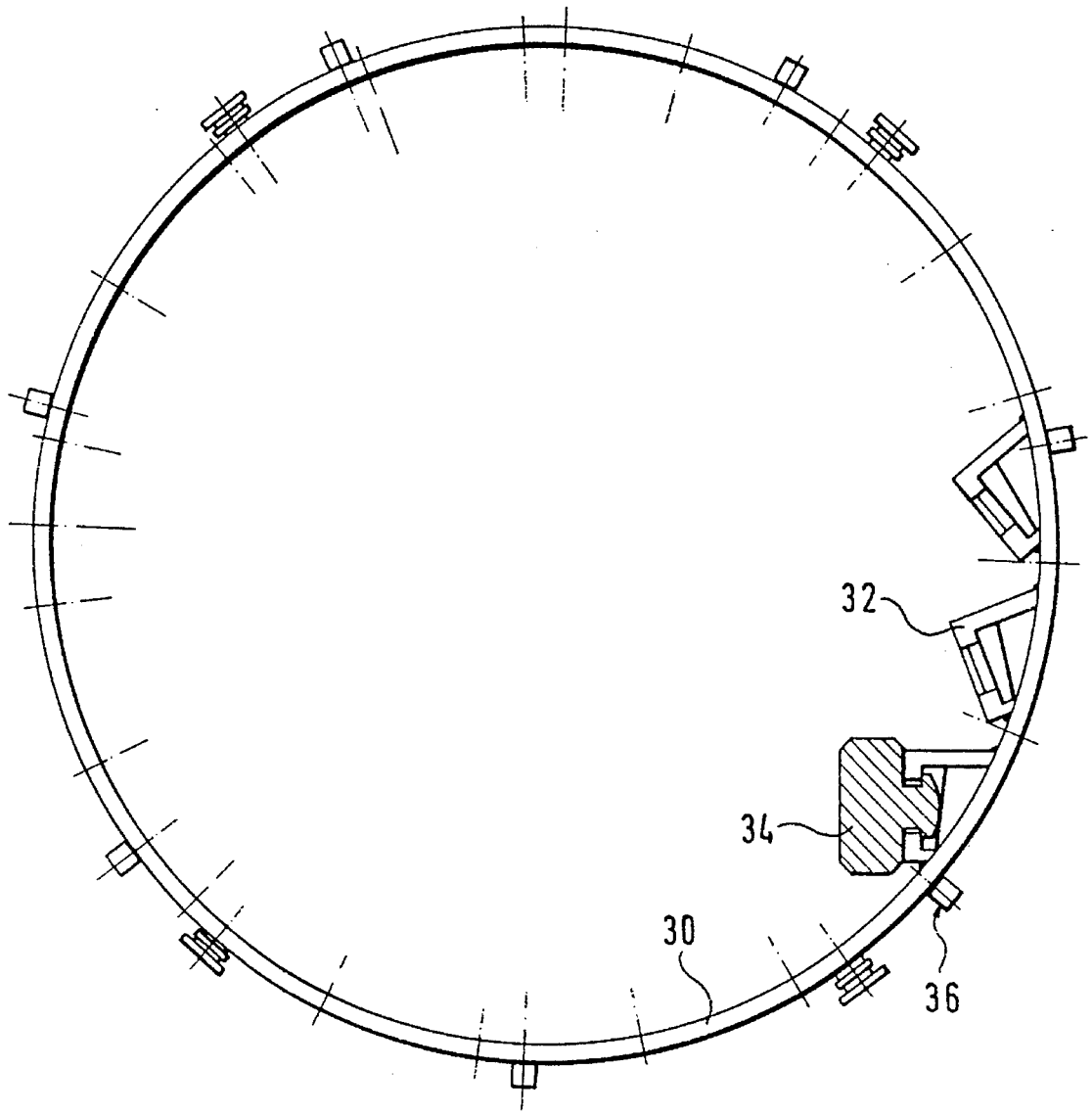
FIG. 2 represents schematically a plan view of an anvil ring according to the present invention.

In accordance with the present invention, the anvil ring 30 is associated with a novel support and positioning system. As can be seen in FIG. 2, the ring 30 is provided on its outer face with a series of journals 36. In the example represented these journals number seven, but this figure is non-limiting and is merely one embodiment.

Figure 3:
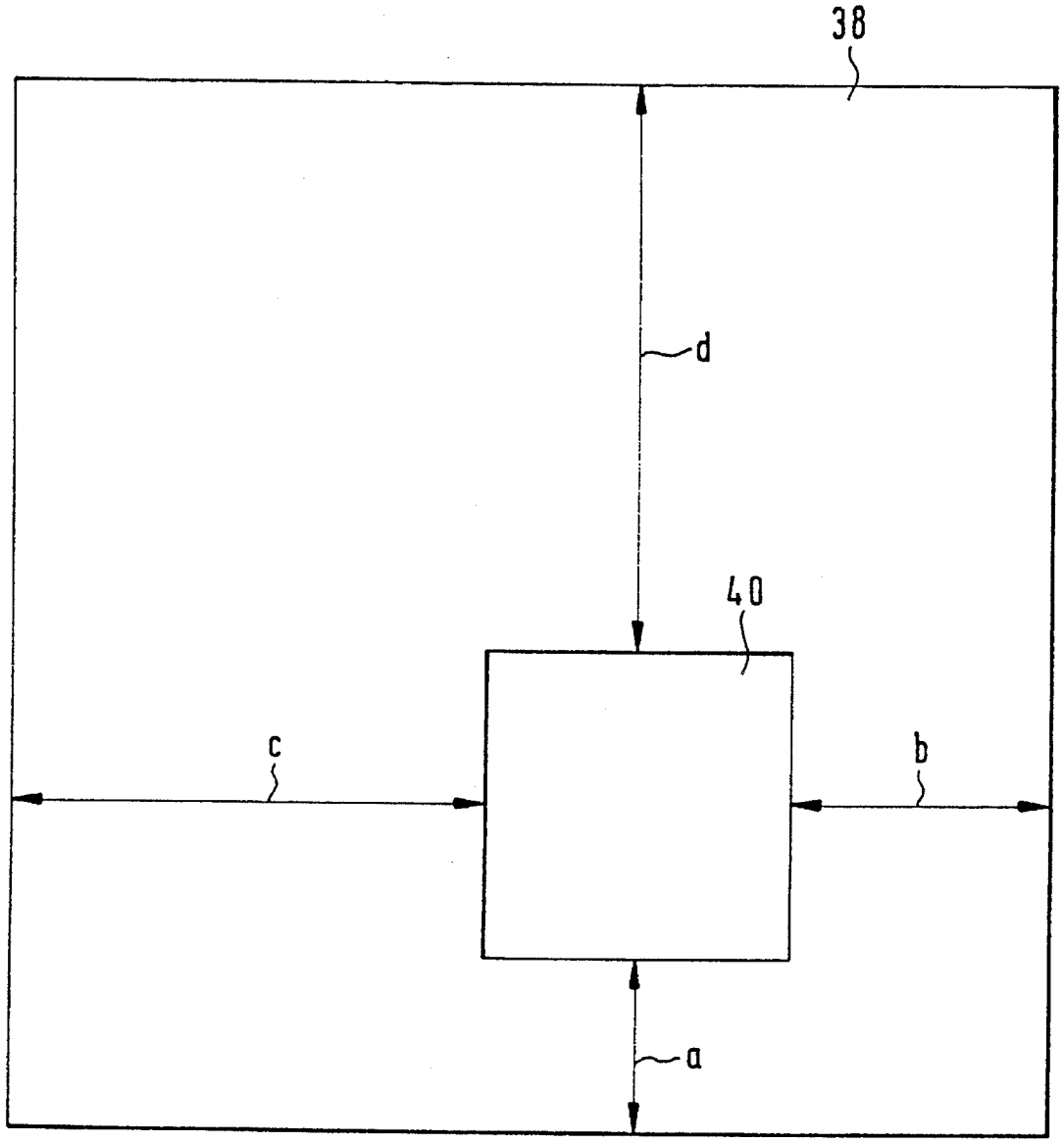
FIG. 3 shows a front-on view of one of the blocks for suspension of the anvil ring.

With each of these journals 36 is associated a block 38 of the sort represented in FIG. 3. This is a plate of polygonal shape, in the example represented of square shape, with a thickness corresponding substantially to the thickness of the lining plates 14 and to the length of the journals 36. Each of these blocks 38 includes an opening 40 of cross-section complementary to that of the journals 36 so that the blocks 38 can be engaged on the journals 36 as shown by FIG. 1.

The anvil ring thus rests on the upper edge of the lining 14 via the block 38, the only fixing being that provided by the weight of the assembly. This has the advantage of creating a sort of "mechanical weak link" effect in so far as, under the effect of violent impact on one or more anvils, the ring 30 can undergo an angular displacement by sliding of all the blocks 38 on the upper edge of the lining. By thus pivoting, the ring 30 is capable of damping out the impacts on the anvils and of reducing the risk of them breaking.

According to another feature of the invention, the suspension of the ring according to the present invention can be ajusted in terms of height. In fact, as can be seen in FIG. 3, the opening 40 in each block 38 is designed so that it is off centred, preferably so that the distances a, b, c, d to each of the sides of the block obey the relationship $a<b<c<d$. As a consequence, there are four possibilities for adjusting the height of the ring 30 depending on the side via which the blocks 38 rest on the lining. This becomes clear from FIG. 1 which, on the right-hand side, shows the ring 30 in a high position and, on the left-hand side, shows the ring 30 in a low position. This is due to the fact that the block 38 on the right of the figure rests on the lining via the side which is the distance d from the opening 40, while the block 38 on the left rests on the side which is the distance a from the opening 40.

Instead of providing square blocks, it is equally possible to provide triangular blocks or polygonal blocks with a number of sides greater than 4. In general, a polygonal block with n sides gives the possibility of n positions for adjusting the height of the ring, these n positions being different from one another if the n distances from the opening to the n sides of the block are different from each other.

In order to change the height of the anvils it is sufficient to remove the cover 16 from the crusher, lift the anvil ring 30 out of the housing 10 with the aid of a lifting machine, move the blocks 38 off their journal 36 laterally and put them back, orienting them so that their side corresponding to the chosen height is at the bottom, and to put the anvil ring and the cover 16 back in place.

In principal, the cross-sections of the journals 36 and of the openings 40 could be round. This would, however, have the disadvantage that when adjusting the height, all the blocks would have to be held manually in the chosen position otherwise, owing to the off-centred nature of the opening 40, they would always swing, under the effect of the imbalance, into the position corresponding to the highest setting of the anvil ring 30.

It is therefore preferable for the cross-sections of the journals 38 and of the openings 40 to be polygonal even if this makes it necessary to take the blocks 38 off the journal 36 in order to change their orientation. Furthermore, in order to benefit from all the adjustment possibilities offered by the configuration of the blocks 38, it is preferable for the polygonal cross-sections of the journals 36 and of the openings 40 to be of the same type as those of the blocks 38, that is to say that if the latter have n sides, the journals 36 and the openings 40 also have n sides.

The system proposed by the present invention thus makes it possible to proceed with easy and quick modification of the level at which the anvils are fixed in order to adapt the crusher to another type of material to be crushed. Likewise, if, during the operation of the crusher, it is noticed that the anvils are wearing more rapidly on the upper side or on the lower side, it is possible to make a compensating correction by modifying the height at which the anvil ring 30 is suspended.

I claim:

1. A centrifugal impact crusher comprising:

a cylindrical housing with a removable closure cover;

a central device for feeding material to be crushed through the cover;

a turntable supported by a vertical bearing and associated with means for turning the table about the central axis of the crusher;

a series of ejectors fixed to the turntable;

a lining, having an upper horizontal edge, aligned with the internal wall of the housing; and an anvil ring having an inner and an outer surface, and further comprising a series of anvils aligned with said inner surface and a series of flat polygonal blocks coupled to said outer surface, wherein the flat polygonal blocks rest on the upper horizontal edge of the lining of the housing and support the anvil ring.

2. The crusher according to claim 1, wherein each flat polygonal block has an off-centered opening and the anvil ring includes a series of journals engaged respectively in each of the openings in the flat polygonal blocks.

3. The crusher according to claim 2, wherein the journals and the openings have complementary polygonal cross-sections, of the same type as those of the flat polygonal block.

4. The crusher according to claim 3, wherein the cross-sections of the flat polygonal blocks, of the openings and of the journals are square.

5. The crusher according to claim 2, wherein the opening in each flat polygonal block is located such that the distances between its centre and each of the sides of the flat polygonal block are different from each other.

6. A centrifugal impact crusher comprising:

a housing;

a device for feeding material to be crushed into the housing;

a rotating table within said housing for receiving said material to be crushed;

a series of ejectors, fixed with respect to said rotating table;

a support device, having an upper edge, aligned with an internal surface of the housing; and an anvil ring, further comprising a plurality of anvils operatively attached to said anvil ring and a plurality of blocks attached to said anvil ring wherein said blocks rest on said upper edge of said support device.

* * * * *